US006395953B1

(12) United States Patent
Koga et al.

(10) Patent No.: US 6,395,953 B1
(45) **Date of Patent: *May 28, 2002**

(54) PROCESS FOR PREPARING PURIFIED CONJUGATED DIENE

(75) Inventors: Takaki Koga, Okayama; Nobumasa Shimomura, Yamaguchi; Masanobu Kanauchi, Tokyo, all of (JP)

(73) Assignee: Nippon Zeon Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/380,003

(22) PCT Filed: Mar. 11, 1998

(86) PCT No.: PCT/JP98/01011

§ 371 (c)(1),
(2), (4) Date: Aug. 24, 1999

(87) PCT Pub. No.: WO98/40448

PCT Pub. Date: Sep. 17, 1998

(30) Foreign Application Priority Data

Mar. 11, 1997 (JP) ..... 9-074569
Mar. 11, 1997 (JP) ..... 9-074571

(51) Int. Cl.[7] ..... C10G 21/28; C10G 21/20; C07C 7/10; C07C 7/00

(52) U.S. Cl. ..... 585/833; 585/807; 585/808; 585/860; 585/861; 585/866; 585/810; 208/313; 208/326; 208/327; 208/330

(58) Field of Search ..... 585/807, 808, 585/833, 860–866, 810; 208/313, 326, 327, 330

(56) References Cited

U.S. PATENT DOCUMENTS

| | | | | |
|---|---|---|---|---|
| 4,134,795 A | | 1/1979 | Howatt, III | 203/53 |
| 4,277,315 A | | 7/1981 | Volkamer et al. | 203/51 |
| 4,278,504 A | | 7/1981 | Volkamer et al. | 203/53 |
| 4,310,388 A | | 1/1982 | Volkamer et al. | 203/51 |
| 4,348,260 A | * | 9/1982 | Hokari et al. | |
| 4,647,344 A | | 3/1987 | Lindner et al. | 203/29 |

FOREIGN PATENT DOCUMENTS

| | | | |
|---|---|---|---|
| FR | 1500693 | | 1/1968 |
| GB | 1171993 A | * | 11/1969 |

(List continued on next page.)

*Primary Examiner*—Walter D. Griffin
*Assistant Examiner*—Tam M. Nguyen
(74) *Attorney, Agent, or Firm*—Dinsmore & Shohl LLP

(57) ABSTRACT

Processes for producing a purified conjugated diene comprise feeding a petroleum fraction containing the conjugated diene to an extractive distillation column, feeding an extraction solvent to the extractive distillation column, and extractive-distilling the conjugated diene from the petroleum fraction containing the conjugated diene in the extractive distillation column. The extraction solvent comprises an amide compound, and a heterocyclic aldehyde, aromatic nitro compound or aromatic aldehyde is contained in the extraction solvent within a range of 0.01 to 10 wt. % based on the weight of the extractive solvent. An oxygen concentration in a gas phase of a distillate discharged from the top of the extraction distillation column is controlled to 10 ppm or lower. The processes further comprise recovering the extraction solvent, purifying the recovered extraction solvent to adjust the content of water in the recovered extraction solvent to within a range of 50 to 500 ppm based on the weight of the extraction solvent, and recovering the isolated conjugated diene. The extraction solvent fed to the extractive distillation column is the purified recovered extraction solvent.

16 Claims, 1 Drawing Sheet

FOREIGN PATENT DOCUMENTS

| | | |
|---|---|---|
| JP | 43-20281 | 8/1968 |
| JP | 45-19682 | 7/1970 |
| JP | 47-41323 | 10/1972 |
| JP | 50-18405 | 2/1975 |
| JP | 50-112304 | 9/1975 |
| JP | 54-138508 | 10/1979 |
| JP | 56-81526 | 7/1981 |
| JP | 58-32685 | 2/1983 |
| JP | 60-166631 | 8/1985 |
| JP | 3-86792 | 4/1991 |

* cited by examiner

PROCESS FOR PREPARING PURIFIED CONJUGATED DIENE

TECHNICAL FIELD

The present invention relates to a process for producing a purified conjugated diene, which comprises a step of isolating a conjugated diene from a petroleum fraction containing the conjugated diene, such as a C4 hydrocarbon fraction or C5 hydrocarbon fraction, by extractive distillation, and more specifically to a process for producing a purified conjugated diene while inhibiting the formation of polymers in the interior of a purification apparatus upon isolation and purification of a highly purified conjugated diene such as isoprene or butadiene from a petroleum fraction.

According to the production process of the present invention, the polymerization of a conjugated diene is prevented in the isolation and purification process of the conjugated diene from the petroleum fraction, thereby inhibiting the formation of popcorn polymers and rubbery polymers in the purification apparatus and preventing a stain on a distillation column and a heat exchanger, and in its turn making it difficult to cause clogging of piping and reduction of thermal efficiency.

BACKGROUND ART

Conjugated dienes such as 1,3-butadiene, isoprene and chloroprene are easy to accidentally form porous insoluble polymers (the so-called popcorn polymers) and rubbery polymers. In particular, the recovering or purifying step of a conjugated diene by industrial distillation has various conditions liable to induce polymerization, such as proper processing temperature, high monomer purity, coexistence of gas and liquid phases, mixing of water and presence of iron rust.

The porous insoluble polymers are crosslinked, solvent-insoluble polymers and called popcorn polymers by reason of their external appearance. Once a popcorn polymer is formed, it becomes a seed to self-multiply, so to speak, exponentially in the presence of the vapor and liquid of a conjugated diene, whereby the interior of the apparatus is rapidly clogged therewith. Since the popcorn polymer is a tough, crosslinked polymer, it is insoluble in known solvents and moreover not melted even when it is heated. Accordingly, the popcorn polymer is extremely difficult to remove.

For the removal of the popcorn polymer, there is no effective removing method except cleaning by a mechanical means. In order to conduct the cleaning, it is necessary to stop the apparatus for a while to disassemble it and mechanically remove the polymer deposited on each part. Therefore, it takes much time, and so this method cannot escape an economical disadvantage. In addition, the popcorn polymer cannot be completely removed by the mechanical cleaning, and so the multiplication of the popcorn polymer restart from a seed which is a trace amount of the popcorn polymer remaining in the interior of the apparatus after operation is resumed. The rubbery polymers adhere to devices such as distillation columns, heat exchangers and piping to stain these devices.

On the other hand, a conjugated diene such as 1,3-butadiene or isoprene is generally isolated and purified from a petroleum fraction containing the conjugated diene, such as a C4 petroleum fraction or C5 petroleum fraction by a series of distilling operations containing extractive distillation. Since many hydrocarbons having similar boiling points to each other are contained in the conjugated diene-containing petroleum fraction, the conjugated diene cannot be isolated and purified by only a distilling process making use of a difference in boiling point. In the isolation and purification process of the conjugated diene from the petroleum fraction, a step of isolating the conjugated diene by extractive distillation making use of a difference in solubility in a solvent is thus provided.

However, even in the isolation and purification process of the conjugated diene including the step of extractive distillation, such popcorn polymers and rubbery polymers as described above are easy to form, and so such a process has also involved a problem that the polymers stain or clog devices, for example, extractive distillation columns, distillation columns, heat exchangers, reflux condensers, evaporators, etc.

In order to prevent the polymerization of a conjugated diene-containing petroleum fraction in a distillation apparatus, it has heretofore been proposed to distill a C5 petroleum fraction in the presence of a di-lower alkylhydroxylamine (N,N-dialkylhydroxylamine) (Japanese Patent Application Laid-Open No. 112304/1975). According to this method, it is said that purified isoprene can be recovered while inhibiting the formation of a popcorn polymer in a distilling step.

As a method of purifying isoprene or butadiene, Japanese Patent Publication Nos. 41323/1972 and 19682/1970 disclose a method in which a hydrocarbon mixture containing a conjugated diene is subjected to extractive distillation using an extraction solvent containing a polymerization inhibitor or chain transfer agent.

Japanese Patent Application Laid-Open No. 81526/1981 and Japanese Patent Publication No. 20281/1968 disclose a method in which a conjugated diene-containing petroleum fraction is subjected to extractive distillation using an extraction solvent containing furfural and a polycondensate of furfural.

However, the conventional methods in which the polymerization inhibitor or chain transfer agent is only caused to exist in the extraction solvent in the extractive distillation of the conjugated diene-containing petroleum fraction fail to prevent the formation of polymers in the distillation apparatus over a long period of time. Therefore, popcorn polymers and rubbery polymers are formed during the operation to stain or clog the distillation apparatus. It is difficult to prevent the formation of the polymers in, particularly, a reflux condenser and an evaporator over a long period of time, so that such a method has involved a problem that piping is clogged, or thermal efficiency in condensation or evaporation is reduced.

DISCLOSURE OF THE INVENTION

It is an object of the present invention to provide a process for producing a purified conjugated diene, comprising a step of isolating a conjugated diene from a petroleum fraction containing the conjugated diene by extractive distillation, by which the formation of popcorn polymers and rubbery polymers can be inhibited over a long period of time.

Another object of the present invention is to provide a process for producing a purified conjugated diene, by which the polymerization of a conjugated diene in an extractive distillation apparatus can be prevented, thereby inhibiting the formation of polymers, a stain on the interior of the apparatus, clogging of piping, reduction in thermal efficiency, etc.

By the way, in techniques that a conjugated diene is isolated from a petroleum fraction containing the conjugated diene by extractive distillation using an amide compound as an extractive solvent, it has heretofore been considered that to prevent penetration of water into the system to the utmost so as to operate the distillation in an non-aqueous state is a preferred process for preventing the formation of polymers and the corrosion of the apparatus.

The present inventors have carried out an extensive investigation repeatedly with a view toward achieving the above objects. As a result, it has been found on the contrary that in a process for producing a purified conjugated diene, comprising a step of isolating a conjugated diene from a petroleum fraction containing the conjugated diene by extractive distillation, an amide compound is used as an extraction solvent, and water is caused to exist in a specific proportion in the extraction solvent composed of an amide compound, whereby the polymerization of the conjugated diene can be prevented.

According to the process of the present invention, the formation of popcorn polymers and rubbery polymers can be inhibited even in a long-term operation to prevent a stain on the distillation apparatus and clogging of piping. In addition, since the concentration of water in the extraction solvent is adjusted within a specific range in the process of the present invention, the corrosion of the distillation apparatus is not facilitated. The present invention has been led to completion on the basis of these findings.

According to the present invention, there is thus provided a process for producing a purified conjugated diene, comprising a step of isolating a conjugated diene from a petroleum fraction containing the conjugated diene by extractive distillation, the step comprising:

(1) using an amide compound as an extraction solvent, (2) feeding the extraction solvent to an extractive distillation column, said extraction solvent having been adjusted in such a manner that water is present within a range of 50 to 1,000 ppm based on the extraction solvent, and (3) subjecting the petroleum fraction to extractive distillation within the extractive distillation column.

BEST MODE FOR CARRYING OUT THE INVENTION

Figure 1:
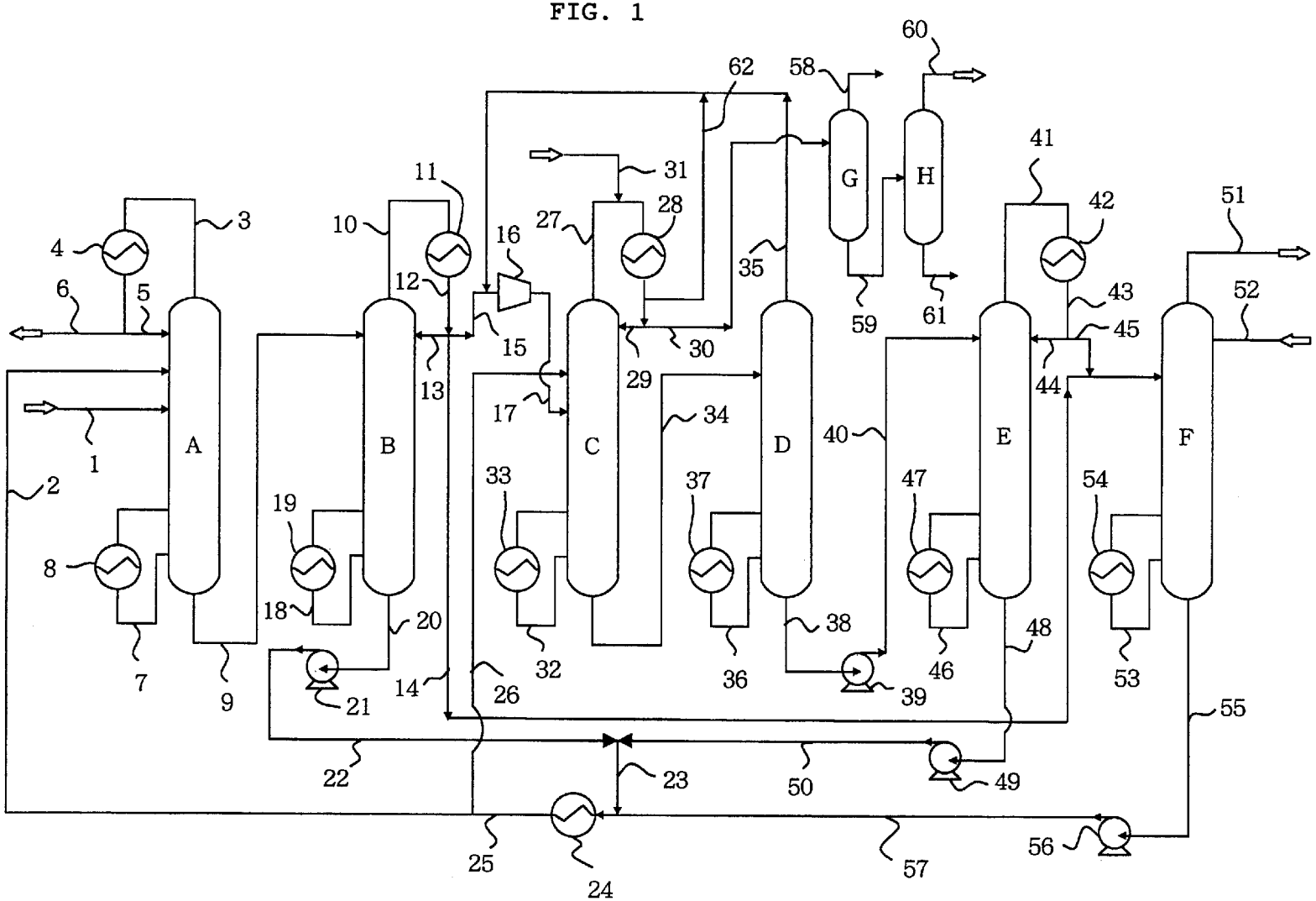
FIG. 1 schematically illustrates an example of an isolation and purification apparatus used in the production process of a purified conjugated diene, comprising a step of isolating butadiene from a C4 hydrocarbon fraction by extractive distillation.

No particular limitation is imposed on the composition of the conjugated diene-containing petroleum fraction used in the present invention so far as the petroleum fraction is a hydrocarbon mixture containing a conjugated diene. As typical examples of such a petroleum fraction, may be mentioned a C4 hydrocarbon fraction containing 1,3-butadiene and a C5 hydrocarbon fraction containing isoprene. Such a petroleum fraction is generally a petroleum fraction obtained by cracking naphtha and separating C2 and C3 hydrocarbons such as ethylene and propylene, and preferably a petroleum fraction the concentration of a conjugated diene contained in which has been heightened by extractive distillation or the like. In particular, the production process according to the present invention is preferably used for a petroleum fraction containing 1,3-butadiene. The conjugated diene-containing petroleum fraction is generally fed to an intermediate plate in an extractive distillation column.

The process for producing a purified conjugated diene, comprising the step of isolating a conjugated diene from the conjugated diene-containing petroleum fraction by extractive distillation typically includes a process by a distilling operation with an extractive distillation step using an extraction solvent and a distillation step making good use of a difference in boiling point combined with each other. A specific example thereof will be now described.

A C4 hydrocarbon fraction such as naphtha-cracked petroleum generally contains various kinds of hydrocarbons such as propane, propylene, isobutene, allene, n-butane, isobutene, 1-butene, trans-2-butene, cis-2-butene, 1,3-butadiene, methylacetylene, 1,2-butadiene and vinylacetylene. In order to recover 1,3-butadiene for polymerization grade containing no polymerization inhibitor such as acetylene derivatives from the C4 hydrocarbon fraction, there is generally adopted an isolation and purification process with an extractive distillation step and a distillation step making use of a difference in boiling point combined with each other. More specifically, there is known, for example, a process comprising (1) removing substances (hardly soluble hydrocarbons) lower in solubility in a solvent than 1,3-butadiene, such as butane and derivatives thereof and butene and derivatives thereof, as a raffinate from a C4 hydrocarbon fraction by a first extractive distillation step, (2) subjecting an extract extracted by the first extractive distillation step and containing 1,3-butadiene and substances (easily soluble hydrocarbons) higher in solubility in a solvent than 1,3-butadiene, such as acetylene derivatives, to a second extractive distillation step to remove the easily soluble hydrocarbons, (3) subjecting a 1,3-butadiene-containing overhead component obtained from the second extractive distillation step to a first distillation step to remove low-boiling substances, and (4) further removing high-boiling substances by a second distillation step, thereby recovering high-purity 1,3-butadiene.

A C5 hydrocarbon fraction is secondarily formed upon the production of ethylene by steam cracking or any other high-temperature treatment of a hydrocarbon. The C5 hydrocarbon fraction generally contains n-pentane, isopentane, 1-pentene, 2-methyl-1-butene, trans-2-pentene, cis-2-pentene, 2-methyl-2-butene, isoprene, trans-1,3-pentadiene, cis-1,3-pentadiene, 1,4-pentadiene, 2-butyne, isopropenyl-acetylene, isopropylacetylene, cyclopentane, cyclopentene and cyclopentadiene. As a process for recovering high-purity isoprene for polymerization grade from the C5 hydrocarbon fraction, there is known, for example, a process comprising (1) removing substances (hardly soluble hydrocarbons) lower in solubility in a solvent than isoprene, such as pentane and derivatives thereof and pentene and derivatives thereof, as a raffinate from a C5 hydrocarbon fraction by a first extractive distillation step, (2) removing most of cyclopentadiene and high-boiling substances such as cyclopentene, cyclopentane and 1,3-pentadiene from an extract extracted by the first extractive distillation step and containing isoprene and substances (easily soluble hydrocarbons) higher in solubility in a solvent than isoprene by a distillation step for removing high-boiling substances, and (3) removing the easily soluble hydrocarbons such as cyclopentadiene and isopropenylacetylene, which are present in a small amount, by a second extractive distillation step.

As described above, in order to recover a high-purity conjugated diene from a hydrocarbon mixture containing a conjugated diene such as 1,3-butadiene or isoprene, in many cases, ① a two-stage extractive distillation process including the first extractive distillation step intended to remove the hardly soluble hydrocarbons and the second extractive distillation step intended to remove the easily soluble hydrocarbons, and ② a distillation process making good use of a difference in boiling point as a process provided between these extractive distillation steps of the two-stage process or after the extractive distillation process are suitably arranged. The isolation of the conjugated diene from the hydrocarbon mixture is conducted by the extractive distillation, and the distillation process is arranged for further purifying the conjugated diene. In such a isolation and purification process, steps such as the separation, recovery, purification, reflux, etc. of the extraction solvent are added. In such a isolation and purification process, a step of removing polymerization inhibiting substances such as acetylene derivatives by chemical reactions may be further added in some cases.

FIG. 1 illustrates an specific example of the production process and apparatus of purified 1,3-butadiene for isolating and recovering 1,3-butadiene from a C4 hydrocarbon fraction containing 1,3-butadiene.

As illustrated in FIG. 1, a gasified C4 hydrocarbon fraction is fed from a pipe 1 to an intermediate plate in a first extractive distillation column A, an extraction solvent such as N,N-dimethylformamide is fed through a pipe 2, and the distillation column is heated at the bottom thereof by a reboiler 8 through a pipe 7 to conduct first-stage extractive distillation. In the first-stage extractive distillation, a raffinate composed of hydrocarbons (propane, propylene, isobutene, allene, n-butane, isobutene, 1-butene, trans-2-butene, cis-2-butene, etc.) lower in solubility in the extraction solvent than 1,3-butadiene is removed from the top of the distillation column through a pipe 3, a condenser 4 and a pipe 6. The main components of the raffinate are butene and derivatives thereof. However, the gas from the top of the distillation column is condensed by the condenser 4, and a part of the condensate is returned back to the top of the extractive distillation column A.

The internal pressure of the first distillation column A is generally 1 to 10 atm, and the bottom temperature is generally 100 to 160° C. The number of plates in the first distillation column A may be suitably preset, but is generally 100 to 300 plates, often, 100 to 200 plates or so.

An extract containing 1,3-butadiene and hydrocarbons (methylacetylene, 1,2-butadiene, vinyl-acetylene, etc.) higher in solubility in the extraction solvent than 1,3-butadiene is taken out of the bottom of the first extractive distillation column A and is fed to the top of a first diffusion column B through a pipe 9. The diffusion column is heated at the lower part thereof by a reboiler 19 through a pipe 18 to evaporate the hydrocarbons, thereby separating them from the solvent. The internal pressure of the diffusion column B is generally 1 to 2 atm, and the bottom temperature is a boiling point at that pressure.

Butadiene, acetylene derivatives and the like are taken out of the top of the diffusion column B and liquefied by a condenser 11 through a pipe 10 to separate them into a liquid and a gas. A part of the liquid is returned back to the top of the diffusion column B through pipes 12 and 13, and the remainder is sent to a water-washing column F through a pipe 14. The extraction solvent is taken out of the bottom of the diffusion column B through a pipe 20 and circulated by a pump 21 to the first extractive distillation column A through pipes 22 and 23 and a condenser 24, and further a pipe 25 and the pipe 2, or fed to a second extractive distillation column C through the pipe 25 and a pipe 26.

The gas discharged from the condenser 11 is introduced into a compressor 16 through a pipe 15, compressed there and then fed to an intermediate plate in the second extractive distillation column C through a pipe 17. The extraction solvent is fed to the second extractive distillation column C through the pipe 26. The second extractive distillation column C is heated at the bottom thereof by a reboiler 33 through a pipe 32 to conduct second-stage extractive distillation. 1,3-Butadiene and hydrocarbons higher in solubility in the extraction solvent than 1,3-butadiene are mainly fed to the second extractive distillation column C. A gas present at the top of the second extractive distillation column C is 1,3-butadiene containing a trace amount of impurities, condensed by a condenser 28 through a pipe 27 and returned back to the top through a pipe 29. The remainder is sent to a first distillation column G through a pipe 30.

A liquid composed mainly of the solvent, which is present at the bottom of the second extractive distillation column C, is sent to an intermediate plate in a butadiene recovering column D through a pipe 34. A distillate taken out of the top of the recovering column D is sent to a compressor 16 through a pipe 35. A bottom product taken out of the bottom of the recovering column D is fed to the top of a second diffusion column E through a pipe 38, a pump 39 and a pipe 40. A reboiler 37 is arranged at the bottom of the recovering column through a pipe 36.

The extraction solvent is recovered from the bottom of the second diffusion column E and returned back to the first extractive distillation column A from the pipe through a pipe 48, a pump 49, a pipe 50, etc., or to the second extractive distillation column C from the pipe 26. A distillate taken out of the top of the diffusion column E is liquefied by a condenser 42 through a pipe 41, and a part thereof is returned back to the diffusion column E through pipes 43 and 44. The remainder is fed to an intermediate plate in the water-washing column F through a pipe 45. The second diffusion column E is so designed that it can be heated by a reboiler 47 through a pipe 46. The operation conditions of the second extractive distillation column C and the second diffusion column E are the same as those of the first extractive distillation column A and the first diffusion column B, respectively.

Water is fed from a pipe 52 to the top of the water-washing column F to subject the extraction solvent to water washing and purification. The extraction solvent thus purified goes through a pipe 55, a pump 56, a pipe 57, etc. to join the extraction solvent flowed from the pipe 23, and the joined extraction solvent is returned back to the first extractive distillation column A through the pipe 2 and to the second extractive distillation column C through the pipe 26. In this case, the content of water in the extraction solvent taken out of the bottom of the water-washing column F is adjusted in such a manner that the water content in the extraction solvent going through each of the pipes 2 and 26 falls within a range of 50 to 1,000 ppm. An exemplary method for adjusting the water content includes a method in which water is added to the purified extraction solvent. A reboiler 54 is arranged at the bottom of the water-washing column F through a pipe 53.

The gas taken out of the top of the second extractive distillation column C is condensed by the condenser 28, and a part of the condensate is returned back to the top of the second extractive distillation column C through the pipe 29. The remainder is fed to the first distillation column G through the pipe 30. In the first distillation column G, impurities each having a boiling point lower than 1,3-butadiene are removed. A distillate from the top of the first distillation column G is condensed by a condenser (not illustrated), and a part of the condensate is returned back to the first distillation column G. The remainder is discharged from a pipe 58 and used as a fuel or burned in a flare stack.

A bottom product taken out of the bottom of the first distillation column G is fed to a second distillation column H through a pipe 59. A distillate discharged from the top of the second distillation column H is condensed by a condenser (not illustrated), and a part of the condensate is returned back to the second distillation column H. The remainder is taken as a high-purity 1,3-butadiene product out of a pipe 60. A flow at the bottom of the second distillation column H is discharged from a pipe 61. With respect to the operating conditions of the respective distillation columns G and H, the internal pressure of each column is 1 to 15 atm, and the column can be operated at a column temperature that is a boiling point at that pressure. The number of plates in the distillation column may be suitably preset, but is generally 50 to 200 plates, often, 100 plates or so.

The production process of a purified diene according to the present invention features that in the step of subjecting a conjugated diene-containing petroleum fraction to extractive distillation by an extractive distillation column using an extraction solvent composed of an amide compound to isolate a conjugated diene, the extraction solvent is adjusted in such a manner that a specific amount of water is present in the extraction solvent at an extraction solvent-feeding plate. By this adjustment, the polymerization of the conjugated diene in the isolation and purification process is prevented. Accordingly, the present invention may also be referred to as a method of preventing the polymerization of a conjugated diene.

The content of water in the extraction solvent at the extraction solvent-feeding plate is 50 to 1,000 ppm, preferably 100 to 500 ppm based on the extraction solvent. In the water content in the extraction solvent is too low, polymers become easy to occur, so that problems such as clogging of piping of the apparatus arise. On the other hand, any water content too high facilitates the corrosion of the apparatus.

Since water is contained in a petroleum fraction fed as a raw material, the content of water in the extraction solvent becomes higher as the extractive distillation of the conjugated diene-containing petroleum fraction is conducted over a long period of time. When the water content is increased, the corrosion of the apparatus is facilitated, resulting in the shortening of apparatus's life. Therefore, water has heretofore been completely removed together with the removal of impurities in an extraction solvent in a step of recovering and purifying the extraction solvent, thereby preventing the corrosion of the apparatus from being facilitated. Accordingly, an extraction solvent substantially free of any water has heretofore been fed to an extraction solvent-feeding plate. On the other hand, in the present invention, the water content in the extraction solvent at the extraction solvent-feeding plate in the step of recovering and purifying the extraction solvent, or the like is adjusted so as to fall within the above range against common sense in the prior art.

In the present invention, an amide compound is used as the extraction solvent. Specific examples of the amide compound include formamide, N,N-dimethylformamide, acetamide, N-ethylacetamide, N,N-dimethylacetamide, N-chloroacetamide, N-bromoacetamide, diacetamide, triacetamide, propionamide, butylamide, isobutylamide, valeramide, isovaleramide, hexanamide, heptanamide, octanamide, decanamide, acrylamide, chloroacetamide, dichloroacetamide, trichloroacetamide, glycol amide, lactamide, pyruvoamide, cyanoacetamide, 2-cyano-3-nitroacetamide, oxamide, malonamide, succinamide, adipamide, malamide, d-tartramide and N,N-dimethylacetone acetic amide. Of these, N,N-dimethylacetamide is preferably used. These solvents may be used either singly or in any combination thereof.

The amount of the extraction solvent is generally 100 to 1,000 parts by weight, preferably 200 to 800 parts by weight per 100 parts by weight of the conjugated diene-containing petroleum fraction.

The extraction solvent is fed to each extractive distillation column from an extraction solvent-feeding plate generally provided at a position above a plate (petroleum fraction-feeding plate) in the extractive distillation column, to which a conjugated diene-containing petroleum fraction (or hydrocarbon mixture) is fed.

In the present invention, it is preferred that the conjugated diene-containing petroleum fraction be fed to an intermediate plate in each extractive distillation column, and an oxygen concentration in a gas phase of a distillate discharged from the top of the extractive distillation column, or preferably a condenser is measured to draw out a part of the gas phase in such a manner that the oxygen concentration is controlled to a specific value or lower.

No particular limitation is imposed on a measuring method of the oxygen concentration in the gas phase of the distillate discharged from the top of the extractive distillation column (preferably, an outlet of the condenser). For example, a part of the gas phase may be sampled from a line connected to an outlet of the top of the extractive distillation column (or condenser) to conduct the measurement, or an oxygen concentration meter may be provided in the line to conduct the measurement at all times.

In the present invention, a part of the gas phase of the distillate discharged from the top of the extractive distillation column is drawn out in such a manner that the oxygen concentration in the gas phase is controlled to preferably 20 ppm or lower, more preferably 10 ppm or lower, most preferably 5 ppm or lower. The gas phase thus drawn out may be discharged from a flare stack or the like, but is preferably mixed with a conjugated diene-containing petroleum fraction (or hydrocarbon mixture), which is a feed stock, to feed it again to the extractive distillation column for the purpose of enhancing the isolating and purifying yield of the conjugated diene. If the oxygen concentration is too high, polymers become easy to occur in a condenser and the like, which incurs a stain on the apparatus and clogging of piping and the like.

In order to further prevent the occurrence of polymers in the present invention, it is preferred that a heterocyclic aldehyde, aromatic nitro compound or aromatic aldehyde be caused to exist in the extraction solvent. The heterocyclic aldehyde, aromatic nitro compound or aromatic aldehyde is an aldehyde having a heterocyclic ring, a nitro compound having a benzene ring or an aldehyde having a benzene ring.

Examples of the heterocyclic aldehyde include furfural, 5-methylfurfural, 5-(hydroxymethyl)furfural, thiophenecarbaldehyde, nicotinic aldehyde and pyridoxal. Of these, furfural is preferred.

Examples of the aromatic aldehyde include benzaldehyde, tolualdehyde, cuminaldehyde, phenylacetaldehyde, cinnamaldehyde, phthalaldehyde, isophthalaldehyde and terephthalaldehyde. Of these, benzaldehyde is preferred.

Examples of the aromatic nitro compound include nitrobenzene, nitrotoluene, α-nitrotoluene, nitroxylene, nitromesitylene, dinitrobenzene, dinitrotoluene, dinitroxylene, trinitrobenzene and trinitroxylene. Of these, nitrobenzene is preferred.

The amount of the heterocyclic aldehyde, aromatic nitro compound or aromatic aldehyde is generally 0.01 to 10 wt. %, preferably 0.05 to 5 wt. % based on the extraction solvent at the extraction solvent-feeding plate.

In order to prevent a stain on the extractive distillation apparatus, it is preferred that monoethanolamine, monomethylamine, dimethylamine, trimethylamine or ethylenediamine be added to the extraction solvent. Similarly, it is preferred that a heterocyclic aldehyde or aromatic aldehyde and a polycondensate of a heterocyclic aldehyde or aromatic aldehyde be added in combination to the extraction solvent. In particular, the combined use of the heterocyclic aldehyde or aromatic aldehyde and tar such as the polycondensate of the heterocyclic aldehyde or aromatic aldehyde is preferred from the viewpoint of preventing the stain on the apparatus.

The amount of the polycondensate of the heterocyclic aldehyde or aromatic aldehyde is generally 0.5 to 10 wt. %, preferably 1 to 5 wt. % based on the extraction solvent at the extraction solvent-feeding plate. It is preferred that the heterocyclic aldehyde or aromatic aldehyde and the polycondensate of the heterocyclic aldehyde or aromatic aldehyde be caused to exist within a range of 1 to 10 wt. % in total in the extraction solvent. If the amount of the polycondensate of the heterocyclic aldehyde or aromatic aldehyde in the extraction solvent is too great, the extraction efficiency tends to lower. If the amount is too small, the heterocyclic aldehyde or aromatic aldehyde in the extraction solvent is consumed in a greater amount, which is not economical.

It is preferred that an oxygen scavenger be contained in the extraction solvent used in the present invention. Examples of the oxygen scavenger include nitrites such as calcium nitrite and sodium nitrite; amines such as hydroxylamine and hydrazine; dithionites such as sodium dithionite; and sulfites such as calcium sulfite, potassium sulfite, manganese sulfite and sodium sulfite. Of these, nitrites are preferred. Since oxygen in the extraction solvent is scavenged by the oxygen scavenger to inhibit radical formation, the polymerization-inhibiting effect is more enhanced. In addition, when a part of a gas phase of a distillate from the top of an extractive distillation column is refed to the extractive distillation column, oxygen in the gas phase can be scavenged by the oxygen scavenger in the extraction solvent circulating in the extractive distillation column, thereby reducing the oxygen concentration in the gas phase of the distillate. The amount of the oxygen scavenger is generally 0.1 to 1.5 parts by weight, preferably 0.2 to 0.8 parts by weight per 1,000 parts by weight of the extraction solvent.

In order to prevent the polymerization of the conjugated diene in the present invention, it is preferred that a polymerization inhibitor be continuously added from a position above the extraction solvent-feeding plate. The polymerization inhibitor used in the present invention is generally that capable of inhibiting or retarding the polymerization of a conjugated diene.

Examples of polymerization inhibitors which inhibit or retard polymerization by scavenging radicals with a stable radical include 1,1-diphenyl-2-picrylhydrazyl, 1,3,5-triphenylferudazyl, 2,6-di-t-butyl-α-(3,5-di-t-butyl-4-oxo-2,5-cyclohexadiene-1-indene)-p-tolyloxy, 2,2,6,6-tetramethyl-4-piperidone-1-oxyl, N-(3-N-oxyanilino-1,3-dimethylbutylidene)-aniline oxide and 2-(2-cyanopropyl)-ferudazyl.

Examples of polymerization inhibitors which inhibit or retard polymerization by a chain transfer reaction include compounds having an active NH bond, such as diphenylpicrylhydrazine, diphenylamine, diethylhydroxylamine, dimethylhydroxylamine, methylethylhydroxylamine, dipropylhydroxylamine, dibutylhydroxylamine and dipentylhydroxylamine; compounds having a phenolic OH bond, such as hydroquinone and t-butylcatechol; and dithiobenzoyl disulfide, p,p'-ditolyl trisulfide, p,p'-ditolyl tetrasulfide, dibenzyl tetrasulfide and tetraethylthiuram disulfide.

Examples of polymerization inhibitors which inhibit or retard polymerization by an addition reaction include oxygen, sulfur, anthracene, 1,2-benzanthracene, tetracene and chloranil; benzoquinone derivatives such as p-benzoquinone, 2,6-dichlorobenzoquinone and 2,5-dichlorobenzoquinone; nitro compounds such as furfurylidenemalononitrile, trinitrobenzene and m-dinitrobenzene; and nitroso compounds such as nitrosobenzene and 2-methyl-2-nitrosopropane.

Additional polymerization inhibitors include metal salts such as ferric chloride and ferric bromide, etc.

Of these polymerization inhibitors, that which inhibits or retards polymerization by a chain transfer reaction, particularly, di-lower alkyl-hydroxylamine, specifically, diethylhydroxylamine is preferred.

The amount of the polymerization inhibitor is generally 0.1 to 20 ppm, preferably 0.5 to 10 ppm based on the total amount of the conjugated diene-containing petroleum fraction and the extraction solvent.

Examples of a position at which the polymerization inhibitor is fed to the extractive distillation column include a side of the extractive distillation column that is situated above the extraction solvent-feeding plate, and an inlet or outlet of a condenser over the top of the extractive distillation column. Of these, the provision at the inlet of the condenser over the top of the distillation column is preferred, since the formation of polymers within the condenser can be effectively inhibited, and moreover the formation of polymers in subsequent steps can also be inhibited.

EXAMPLES

The present invention will hereinafter be described more specifically by the following Examples and Comparative Examples. All designations of "part" or "parts" and "%" in the following examples mean part or parts by weight and % by weight unless expressly noted.

Example 1

The following experiment was conducted by means of the isolation and purification apparatus of a butadiene-containing C4 hydrocarbon fraction as illustrated in FIG. 1. (First Extractive Distillation)

A gasified C4 hydrocarbon fraction was fed to an intermediate plate in the first extractive distillation column A, N,N-dimethylformamide (hereinafter may be referred to merely as the extraction solvent a) containing 1% of furfural and 300 ppm of water was fed from the pipe 2, and the distillation column was heated at the bottom thereof by the reboiler 8 to conduct first-stage extractive distillation. A gas taken out of the top of the extractive distillation column A was condensed by the condenser 4, and a part of the condensate was returned back to the top of the extractive distillation column A. The remainder was a fraction containing butane, butylene and the like in plenty, which was taken out of the pipe 6. A butadiene extract containing higher acetylene and allene type hydrocarbons was taken out of the bottom of the extractive distillation column A. This extract was fed to the top of the first diffusion column B through the pipe 9. The diffusion column was heated at the lower part thereof by the reboiler 19 to evaporate the hydrocarbons, thereby conducting distillation.

Butadiene, higher acetylene and allene type hydrocarbons were taken out of the top of the diffusion column B and liquefied by the condenser 11. A part of the thus-liquefied liquid was returned back to the top of the diffusion column B, and the remainder was sent to the water-washing column F through the pipe 14. The extraction solvent a was taken out of the bottom of the diffusion column B and circulated by the pump 21 via the condenser 24 to the first extractive distillation column A through the pipe 2 or to the second extractive distillation column C through the pipe 26.

(Second Extractive Distillation)

A gas discharged from the condenser 11 was fed to an intermediate plate in the second extractive distillation column C through the compressor 16 and the pipe 17. The extraction solvent a was fed to the second extractive distillation column C from the pipe 26, and diethylhydroxylamine was further fed from the pipe 31 provided before the inlet of the condenser 28. The second extractive distillation column C was heated at the bottom thereof by the reboiler 33 to conduct second-stage extractive distillation.

A liquid taken out of the bottom of the second extractive distillation column C was sent to an intermediate plate in the recovering column D. A distillate taken out of the top of the recovering column D was sent to the compressor 16 through the pipe 35.

A bottom product taken out of the bottom of the recovering column D was fed to the top of the second diffusion column E through the pump 39 and the pipe 40. The extraction solvent was recovered from the bottom of the second diffusion column E. A distillate taken out of the top of the diffusion column E was liquefied by the condenser 42, and a part thereof was returned back to the diffusion column E. The remainder was fed to an intermediate plate in the water-washing column F through the pipe 45.

Water was fed from the pipe 52 to the top of the water-washing column F to purify the extraction solvent a, and the amount of water was adjusted (for example, by adding water) in such a manner that the water content in the extraction solvent a in the pipes 2 and 26 was controlled to 300 ppm. The extraction solvent a the water content of which had been adjusted went through the pipe 55, the pump 56 and the pipe 57 to join the extraction solvent a flowed from the pipe 23, and the joined extraction solvent was circulated to the first extractive distillation column A through the pipe 2 and to the second extractive distillation column C through the pipe 26 to reuse it.

A gas taken out of the top of the second extractive distillation column C was condensed by the condenser 28, and a part of the condensate was returned back to the top of the second extractive distillation column C. The remainder was fed to the top of the first distillation column G through the pipe 30. A distillate discharged from the top of the first distillation column G was condensed by a condenser (not illustrated), and a part of the condensate was returned back to the first distillation column G. The remainder was used as a fuel or burned in a flare stack.

A bottom product discharged from the bottom of the first distillation column G was fed to an intermediate plate of the second distillation column H. A distillate discharged from the top of the second distillation column H was condensed by a condenser (not illustrated), and a part of the condensate was returned back to the second distillation column H. The remainder was taken out as purified 1,3-butadiene of high purity and provided as a raw material for polybutadiene and the like.

The apparatus was continuously run over 2 years in accordance with this process. As a result, popcorn polymers and rubbery polymers were only slightly formed in the respective parts of the purification apparatus, such as piping, extractive distillation columns, condensers and reheater (reboilers), a stain on the interior of the apparatus was slight, and no corrosion was caused as well.

Example 2

The apparatus was run in the same manner as in Example 1 except that N,N-dimethylformamide containing 1% of a heterocyclic aldehyde or aromatic aldehyde, 200 ppm of water and 0.05% of sodium nitrite was used in place of the extraction solvent a, a gas was sampled from an outlet of the condenser 28 to determine an oxygen concentration in the gas by gas chromatography, and a part of a gas phase of a distillate discharged from the condenser 28 was returned back to an inlet of the compressor 16 through the pipe 62 to adjust the oxygen concentration to give a measured value of 5 ppm or lower.

The apparatus was continuously run over 2 years in accordance with this process. As a result, popcorn polymers and rubbery polymers were only slightly formed in the respective parts of the purification apparatus, such as piping, extractive distillation columns, condensers and reheater (reboilers), a stain on the interior of the apparatus was slighter than the case of Example 1, and no corrosion was caused as well.

Comparative Example 1

1,3-Butadiene was isolated and purified from a C4 hydrocarbon fraction in the same manner as in Example 1 except that the extraction solvent a used in Example 1 was changed to dimethylformamide containing 30 ppm of water.

The apparatus was continuously run over 2 years in accordance with this process. As a result, popcorn, polymers and rubbery polymers were formed in plenty in the respective parts of the purification apparatus, particularly, the condenser 28, the second extractive distillation column C and the reboiler 33, and so the interior of the apparatus was stained to a great extent. In addition, the reboiler 33 was clogged in one and a half years, and so the reboiler had to be disassemble to clean it.

Comparative Example 2

1,3-Butadiene was isolated and purified from a C4 hydrocarbon fraction in the same manner as in Example 1 except that the extraction solvent a used in Example 1 was changed to N,N-dimethylformamide containing 1,650 ppm of water.

The apparatus was continuously run over 2 years in accordance with this process. As a result, corrosion was observed in the apparatus, and moreover polymerization caused a stain to a great extent.

INDUSTRIAL APPLICABILITY

According to the production process of the present invention, polymerization reactions can be effectively prevented in the isolation and purification process of a conjugated diene from a petroleum fraction containing the conjugated diene, thereby inhibiting the formation of popcorn polymers and rubbery polymers, preventing a stain on the interior of the apparatus, clogging of piping and reduction of thermal efficiency in condensers and reboilers, and lengthening a term during which cleaning may not be conducted, so that the economical isolation and purification of the conjugated diene becomes feasible by a long-time continuous operation.

What is claimed is:

1. A process for producing a purified conjugated diene, comprising steps of (a) feeding a petroleum fraction containing conjugated diene to an extractive distillation column, (b) feeding an extraction solvent to the extractive distillation column, wherein the extraction solvent comprises an amide compound and wherein a heterocyclic aldehyde, aromatic nitro compound or aromatic aldehyde is contained in the extraction solvent within a range of 0.01 to 10 wt. % based on the weight of the extraction solvent, (c) extractive-distilling the conjugated diene from the petroleum fraction containing the conjugated diene in the extractive distillation column, (d) controlling an oxygen concentration in a gas phase of a distillate discharged from the top of the extractive distillation column to 10 ppm or lower, (e) recovering the extraction solvent, (f) purifying the recovered extraction solvent to adjust the content of water in the recovered extraction solvent to within a range of 50 to 500 ppm based on the weight of the extraction solvent, and (g) recovering the isolated conjugated diene, wherein the extraction solvent fed to the extractive distillation column in step (b) is the purified extraction solvent from step (f).

2. The production process according to claim 1, wherein the amide compound is dimethylformamide.

3. The production process according to claim 1, wherein the heterocyclic aldehyde is furfural.

4. The production process according to claim 1, wherein an additional polycondensate of a heterocyclic aldehyde or aromatic aldehyde is contained in the extraction solvent fed to the extractive distillation column within a range of 0.5 to 10 wt. % based on the weight of the extraction solvent.

5. The production process according to claim 4, wherein a heterocyclic aldehyde or aromatic aldehyde and a polycondensate of a heterocyclic aldehyde or aromatic aldehyde are contained in the extraction solvent within a range of 1 to 10 wt. % in total.

6. The production process according to claim 4, wherein the polycondensate of the heterocyclic aldehyde is a polycondensate of furfural.

7. The production process according to claim 1, wherein a polymerization inhibitor is continuously fed to the extractive distillation column from a position above an extraction solvent-feeding plate thereof.

8. The production process according to claim 7, wherein the polymerization inhibitor is adapted to inhibit or retard the polymerization of the conjugated diene by a chain transfer reaction.

9. The production process according to claim 8, wherein the polymerization inhibitor is a di-lower alkylhydroxylamine.

10. The production process according to claim 7, wherein the polymerization inhibitor is continuously fed from an inlet of a condenser provided over the top of the extractive distillation column.

11. The production process according to claim 1, wherein the conjugated diene-containing petroleum fraction is fed to an intermediate plate of the extractive distillation column.

12. The production process according to claim 11, wherein an oxygen scavenger is contained in the extraction solvent.

13. The production process according to claim 12, wherein the oxygen scavenger is a nitrite.

14. The production process according to claim 11, further comprising mixing the gas phase with the petroleum fraction fed to the intermediate plate of the extractive distillation column.

15. The production process according to claim 1, wherein the recovered extraction solvent is purified to adjust the content of water in the recovered extraction solvent to within a range of 100 to 500 ppm based on the weight of the extraction solvent.

16. The production process according to claim 1, wherein the oxygen concentration in the gas phase of the distillate discharged from the top of the extractive distillation column is controlled to 5 ppm or lower.

* * * * *